US006485067B1

(12) United States Patent
Root

(10) Patent No.: US 6,485,067 B1
(45) Date of Patent: Nov. 26, 2002

(54) SLIDING ROD CLOSURE FOR A CABINET DOOR HINGED ON A SWITCH CABINET BODY

(75) Inventor: Paul Root, Bad Endbach (DE)

(73) Assignee: Rittal-Werk Rudolf Loh GmbH & Co. KG, Herborn (DE)

( * ) Notice: Subject to any disclaimer, the term of this patent is extended or adjusted under 35 U.S.C. 154(b) by 0 days.

(21) Appl. No.: 09/509,202

(22) PCT Filed: Sep. 12, 1998

(86) PCT No.: PCT/EP98/05815

§ 371 (c)(1),
(2), (4) Date: Jun. 15, 2000

(87) PCT Pub. No.: WO99/16994

PCT Pub. Date: Apr. 8, 1999

(30) Foreign Application Priority Data

Sep. 26, 1997 (DE) ..... 197 42 511

(51) Int. Cl.[7] ..... E05C 1/06; E05B 65/44
(52) U.S. Cl. ..... 292/142; 292/279; 70/78
(58) Field of Search ..... 70/78, 81; 292/39, 292/142, 160, 279

(56) References Cited

U.S. PATENT DOCUMENTS 1,515,611 A * 11/1924 O'Connor ..... 70/81
4,616,864 A * 10/1986 Douglas ..... 292/336.3
4,934,800 A * 6/1990 Choi ..... 292/172
5,642,909 A * 7/1997 Swan et al. ..... 292/39
5,810,402 A * 9/1998 Armstrong ..... 292/39

FOREIGN PATENT DOCUMENTS

| | | |
|---|---|---|
| DE | 90 10 175.8 | 10/1990 |
| DE | 90 17 302.3 | 4/1991 |
| EP | 261 266 | 3/1988 |

* cited by examiner

*Primary Examiner*—S. Joseph Morano
*Assistant Examiner*—Andy Wright
(74) *Attorney, Agent, or Firm*—Pauley Petersen Kinne & Erickson

(57) ABSTRACT

A sliding rod closure for a cabinet door hinged on a switch cabinet body having a locking mechanism which has an actuating member displaceable in the direction of rotation. The actuating member is coupled to a sliding unit that has a spaced adjusting member situated perpendicular to the sliding direction of the rotational axis of the actuating member. The adjusting member can be operated by the actuating member. The sliding rod closure can be used to meet various requirements thus resulting in an easier operation. The adjusting member can be assigned to the actuating member in a variety of assembly positions, whereby the sliding direction of the sliding unit is maintained in various assembly positions. However, the direction of rotation of the actuating member is modified or the sliding direction of the sliding unit is also modified, and the direction of rotation of the actuating member is maintained.

11 Claims, 3 Drawing Sheets

SLIDING ROD CLOSURE FOR A CABINET DOOR HINGED ON A SWITCH CABINET BODY

BACKGROUND OF THE INVENTION

1. Field of the Invention

This invention relates to a sliding rod closure for a cabinet door hinged to a switchgear cabinet body, having a locking mechanism which has an actuating member displaceable in a direction of rotation and which is coupled to a sliding unit, the sliding unit having a spaced adjusting member positioned perpendicular to the sliding direction of the rotational axis of the actuating member, which adjusting member can be operated by the actuating member.

2. Description of Related Art

A sliding rod closure is known from German Patent Reference DE 90 10 175 Ul. Here a locking mechanism in the form of a gear case is placed on the inner side of a cabinet door. A pinion is rotatably accommodated in the gear case and can be turned with a handle. The sliding unit is guided in the gear case. The sliding unit is formed by two racks, the teeth of which are located diametrically opposite with respect to their toothing and both of which engage with the pinion. Sliding rods for locking the cabinet door are coupled to the racks. When the handle arranged on the front side of the cabinet door is rotated, the racks are displaced in opposite directions. Rotating clockwise causes the cabinet door to open, rotating counterclockwise causes the door to close. If the type of rabbet of the cabinet door is changed, the latter is rotated around 180°. But the direction of rotation of the handle is thus also changed, for example rotating clockwise causes locking. However this is undesired for ease of operation.

To overcome this disadvantage, it is proposed in European Patent Reference EP 0 261 266 B1, that both the handle and the locking mechanism be modified when the type of rabbet is changed. With this modification, the direction of rotation can be maintained. However, a large cost outlay is necessary for such a measure. Moreover, it is frequently required, as a result of space conditions, for the handle to be able to be rotated optionally either clockwise or counterclockwise, with a given type of rabbet of the cabinet door. However, the use of two different closures is thus provided.

SUMMARY OF THE INVENTION

One object of this invention is to create a sliding rod closure of the type mentioned initially which can be used for various applications and is easy to operate.

This object is achieved with an adjusting member that can be assigned to the actuating member in various assembly positions. The sliding direction of the sliding unit is maintained in the changed assembly positions, but the direction of rotation of the actuating member can be changed and/or the sliding direction of the sliding unit can be changed in the changed assembly positions but the direction of rotation of the actuating member is maintained.

According to this invention, with the sliding rod closure a fitting is available which makes possible variable locking positions as a result of simple modification measures. Depending on the association of the adjusting member with the actuating member, the sliding direction of the sliding unit and the direction of rotation of the actuating member can be adjusted independently of one another.

Space-saving construction is possible if the sliding is configured plate-like and is applied flat to the front side of the cabinet door. In particular, the rear side of the cabinet door is kept free of components of the sliding rod closure, to reduce cramped space conditions particularly in an edge region of the cabinet door.

In one embodiment of this invention the actuating member is configured as a pinion, the teeth of which co-operate with the adjusting member configured as toothing.

Thus, the rack-like adjusting member, seen in the sliding direction, is engaged with the pinion, optionally on the left-hand side or on the right-hand side.

A part of the rack-like adjusting member effecting the advance, seen transversely with respect to the sliding direction, can be arranged optionally on the left side or the right-hand side of the pinion. With these simple measures, the direction of rotation of the actuating member or respectively the sliding direction of the sliding unit may be adjusted.

According to a preferred embodiment of this invention, the sliding unit can have a break-through area, in which the actuating member is accommodated, for the sliding unit to be coupled to a sliding rod of the locking mechanism, and for the securing points, at which the sliding unit is connected to the sliding rod and at which the pivot point of the actuating member is connected, to be arranged on a line running in the sliding direction. As a result of this symmetrical configuration, the sliding unit can be assigned to the actuating member in various assembly positions.

A simple structure is formed with a few parts if the sliding unit is held adjustable with a casing in the sliding direction, if the casing will accommodate rotatably a rotary body, and if the actuating member is held in a non-rotatable position on the rotary body.

It is thus possible for the casing, the sliding unit, the rotary body and the actuating member to be combined to form a pre-assembled unit, which may be fastened to the cabinet door. The sliding unit can be attached via coupling elements to the sliding rod of the locking mechanism.

The sliding unit is preferably arranged on the front side, and the sliding rod on the rear side of the cabinet door. Through an opening in the cabinet door, the sliding unit is operatively connected to the sliding rod.

BRIEF DESCRIPTION OF THE DRAWINGS

This invention is explained in greater detail in view of embodiments shown in the drawings wherein.

DESCRIPTION OF PREFERRED EMBODIMENTS

Figure 1:
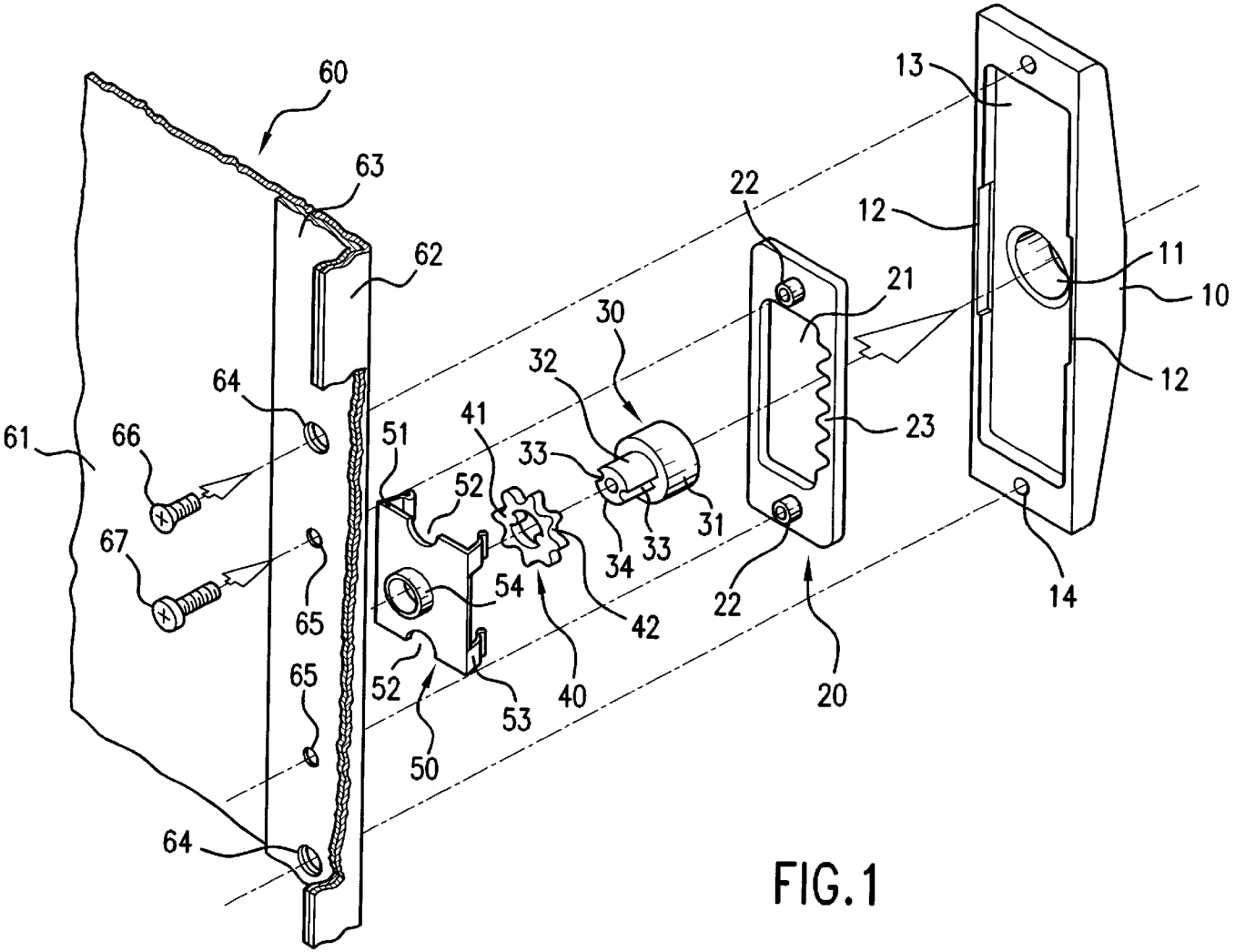
FIG. 1 is a sliding rod closure, in a perspective exploded view.

A sliding rod closure according to this invention is shown in detail in FIG. 1. This sliding rod closure can be attached to the front side of a cabinet door 60. The cabinet door 60 has a flat door leaf 61, which has at its edge bent-over portions 62. In the bent-over region, a sliding rod 63 can be attached to the inner side of the cabinet door 60. The sliding rod 63 is configured as a metal angle and abuts against the door leaf 61 and the bent-over portion 62.

The sliding rod closure has a casing 10 with a receiver 13. The receiver 13 is incorporated as a rectangular recess in the region of the casing facing the door leaf 61. From the front of the casing 10 one obtains access to the receiver 13 through a bearing 11 which is configured as a bore. The bore axis is perpendicular to the door leaf 61. In the bearing 11, a rotary body 30 can be mounted. The rotary body 30 has a cylindrical bearing journal 31. A plug-in lug 32 is connected to the bearing journal 31. The plug-in lug 32 has two diametrically opposite recesses 33 to which an actuating member 40 can be secured by means of extensions 41. The actuating member 40 is preferably configured as a pinion and has a central plug receiver, by means of which it can be pushed on the plug-in lug 32. In order to secure the pinion, a threaded receiver 34 is incorporated in the end face of the plug-in lug 32.

A sliding unit 20 can be inserted into the receiver 13 of the casing 10. The sliding unit 20 is configured plate-like and has a width configured to match the width of the receiver 13. The length of the sliding unit 20 running in a vertical direction is, however, selected smaller than the length of the receiver 13. Thus the sliding unit 20 can be displaced in linear fashion in the casing 10. Coupling elements 22 are secured to the sliding unit 20. The coupling elements 22 are configured as threaded bushings which project at the front beyond the sliding unit 20. The sliding unit 20 has a central breakthrough area 21 which is delimited at one side by an adjusting member 23. The sliding member 23 is integrally formed on the sliding unit 20 as a rack. When the sliding unit 20 is inserted, the toothing of the adjusting member 23 meshes with the toothing of the actuating member 40. In order to fix the sliding unit 20, the rotary body 30 and the actuating member 40, a mounting 50 is used. The mounting 50 has a base plate 51, from which four locking projections 53 are bent away in a direction towards the casing 10. The mounting 50 can be locked with the locking projections 53 on locking receivers 12 of the casing 10. Thus the casing 10, the sliding unit 20, the rotary body 30, the actuating member 40 and the mounting 50 form a constructional unit which is preassembled. The mounting 50 has a bearing bush 54 which receives the plug-in lug 32 of the rotary body 30 at the end. With the bearing bush 54 and the bearing 11, bedding of the rotary body 30 is achieved on both sides.

To secure the casing 10 to the cabinet door, the door leaf 61 has bores 64 aligned with threaded receivers 14 of the casing 10. Bore 64 is configured as a sink-hole bore, such that a corresponding screw 66 can be received flush with the surface of the door leaf 61. The sliding rod 63 has a corresponding opening, such that the screw 66 is introduced into bore 64 and screwed into the thread 14. Because the screw 66 is received sunk in relation to the surface of the door leaf 61, the sliding rod 63 can be displaced unhindered on the door leaf 61. To couple the sliding rod 63 to the sliding unit 20, bores 65 are in the sliding rod 63. The bores 65 are in alignment with the coupling elements 22 which are configured with corresponding threads. The sliding unit 20 can be screwed via the bores 65 to the sliding rod 63 by means of screws 67.

The rotary body 30 is accessible from the front side of the casing 10 and serves to receive a key or a handle. As a result of rotating the key or handle, the rotary body 30 is rotated. With the rotary body 30, the actuating member also rotates. The actuating member 40 displaces the sliding rod 20 as a result of engagement in the adjusting member 23. Because the sliding unit 20 is connected to the sliding rod 63 via coupling elements 22, displacement of the sliding rod 63 in a vertical direction is also caused via adjustment of the adjusting member 23.

In FIGS. 2A to 2D, different assembly positions are shown in which the actuating member 40 corresponds to the adjusting member 23. In these drawings, an inner front elevation of the cabinet door 60 is represented diagrammatically, the sliding rod closure being represented in an enlarged view. On the right-hand side of the cabinet door are arranged hinges 68, for hinging to a switchgear cabinet body or the like.

Figure 2A:
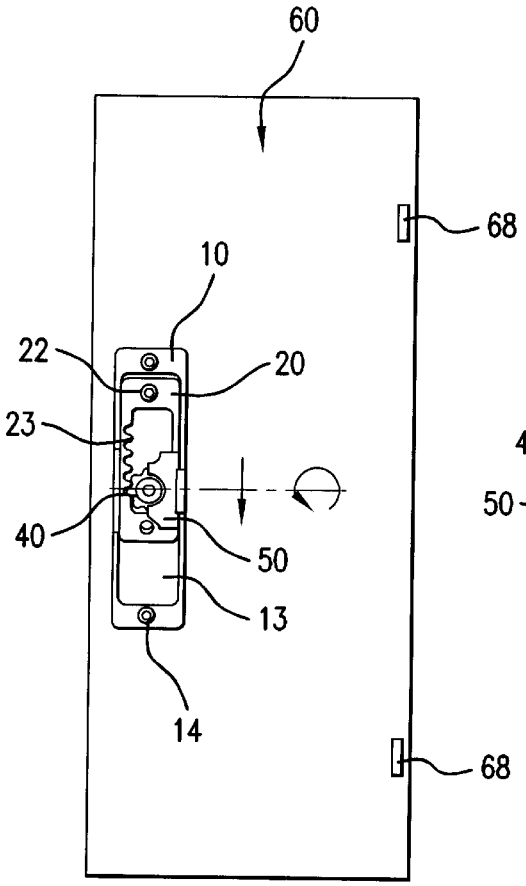
FIGS. 2A to 2D each show a front view of a different assembly position of the sliding rod closure on a cabinet door.
Figure 2B:
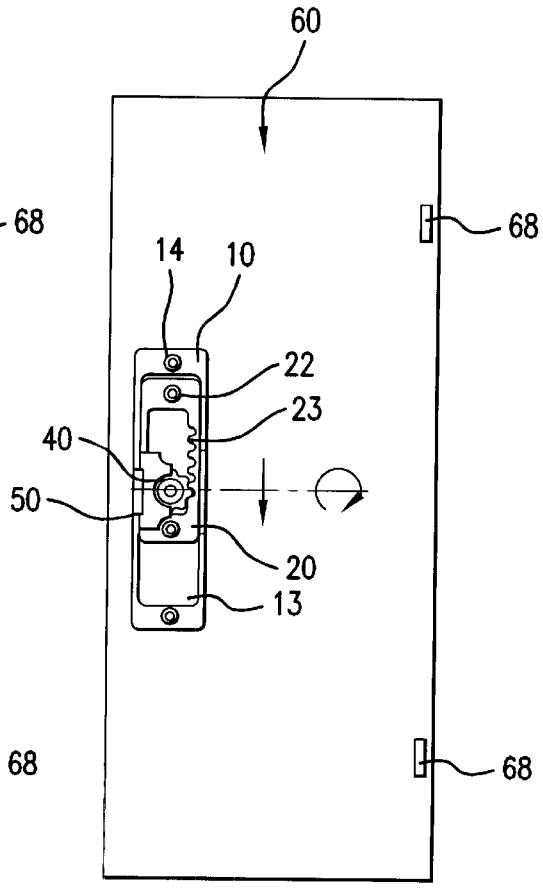

In FIG. 2A, the adjusting member 23 is located transversely with respect to the locking direction, the sliding direction of the sliding unit 20, at the left-hand side of the actuating member 40. The part of the rack-shaped adjusting member effecting the advance is disposed, seen in the sliding direction, at the right-hand side of the actuating member 40. With this arrangement, when the rotary body 30 is rotated counterclockwise, and with it the actuating member 40, there is displacement of the sliding unit 20, vertically downwards. If the direction of rotation of the actuating member 40 is altered, then the sliding unit 20 is rotated so that the adjusting member 23 is disposed, seen transversely with respect to the sliding direction of the sliding unit 20, at the right-hand side of the actuating member 40. This assembly position is represented in FIG. 2B. With such an arrangement, when the actuating member 40 is rotated clockwise, the downward locking direction is maintained.

Figure 2C:
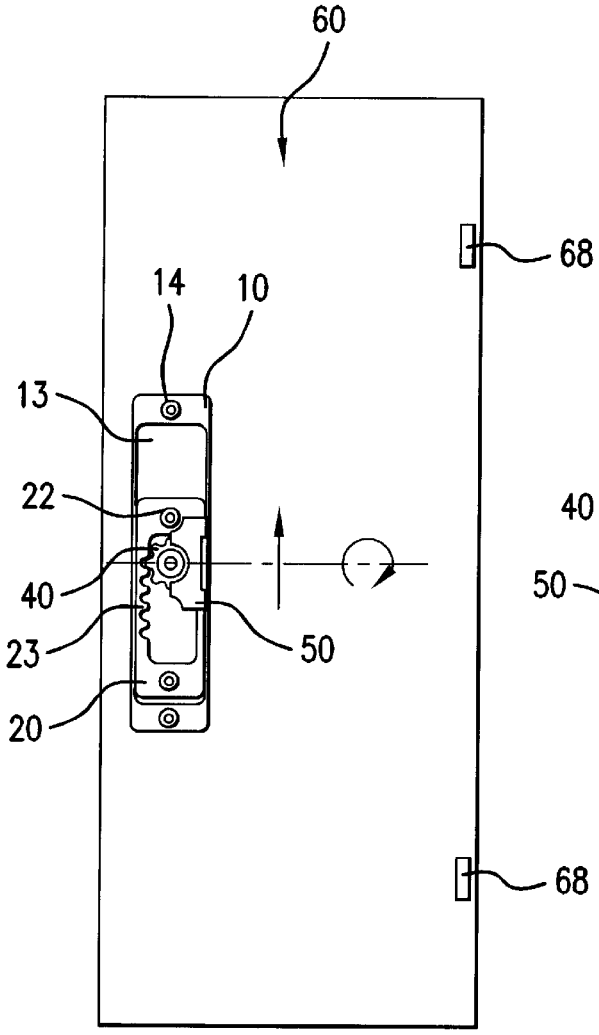
Figure 2D:
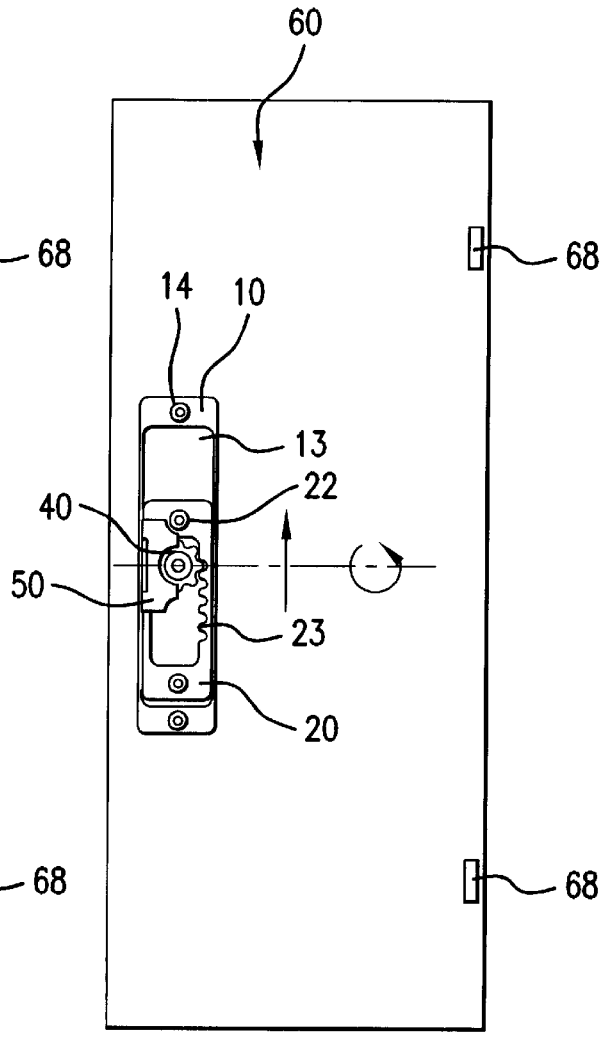

FIGS. 2C and 2D show assembly positions in which the locking direction is directed upwards. Here the portion of the rack-shaped adjusting member effecting the advance is disposed, seen in the sliding direction, at the left-hand side of the actuating member 40. Seen transversely with respect to the sliding direction, the adjusting member 23 is also mounted on the left-hand side of the actuating member 40. In this assembly position, the locking direction is upwards when the actuating member 40 is rotated clockwise. In the position of the sliding unit 20 changed by 180°, the direction of rotation of the actuating member can be reversed, as shown in FIG. 2D.

What is claimed is:

1. In a sliding rod closure for a cabinet door hinged to a switchgear cabinet body, having a locking mechanism with a rotatable actuating member coupled to a sliding unit, the sliding unit having a spaced adjusting member positioned perpendicular to a sliding direction of a rotational axis of the actuating member, wherein the adjusting member can be operated by the actuating member, the adjusting member can be assigned to the actuating member (40) in a plurality of assembly positions, the sliding direction of the sliding unit being maintained in the assembly positions and a rotation direction of the actuating member (40) being changed, and wherein the actuating member (40) is configured as a pinion with teeth that co-operate with toothing of the rack-shaped adjusting member, the improvement comprising:

the adjusting member (23) positioned transverse with respect to the sliding direction of the rotational axis of the actuating member (40) and perpendicular to the rotational axis of the actuating member (40) and engageable with the pinion on one of a left-hand side and a right-hand side, the sliding unit (20) being disposed on a front side of the cabinet door (60) and a sliding rod (63) on a rear side of the cabinet door (60) and the cabinet door (60) having an opening through which the sliding unit (20) is connected to the sliding rod (63).

2. In the sliding rod closure according to claim 1, wherein the sliding unit (20) is configured as a plate.

3. In the sliding rod closure according to claim 2, wherein a part of the rack-shaped adjusting member (23) effecting an advance is disposed in the sliding direction on one of the left-hand side and the right-hand side of the pinion.

4. In the sliding rod closure according to claim 3, wherein the sliding unit (20) has a break-through area (21) in which the actuating member (40) is accommodated, the sliding unit (20) is coupled to at least one sliding rod (63) of the locking mechanism, and a plurality of securing points at which the sliding unit (20) is connected to the sliding rod (63) and at which a pivot point of the actuating member (40) is connected are arranged on a line along the sliding direction.

5. In the sliding rod closure according to claim 4, wherein the sliding unit (20) is adjustably mounted in the sliding direction in a casing (10), and the casing (10) rotatably bears a rotary body (30), and the actuating member (40) is held non-rotatable on the rotary body (30).

6. In the sliding rod closure according to claim 5, wherein the casing (10), the sliding unit (20), the rotary body (30) and the actuating member (40) are combined into a pre-assembled unit, and the sliding unit is bound via coupling elements (22) to the at least one sliding rod (63) of the locking mechanism.

7. In the sliding rod closure according to claim 1, wherein a part of the rack-shaped adjusting member (23) effecting an advance is disposed in the sliding direction on one of the left-hand side and the right-hand side of the pinion.

8. In a sliding rod closure for a cabinet door hinged to a switchgear cabinet body, having a locking mechanism with a rotatable actuating member coupled to a sliding unit, the sliding unit having a spaced adjusting member positioned perpendicular to a sliding direction of a rotational axis of the actuating member, wherein the adjusting member can be operated by the actuating member, the adjusting member can be assigned to the actuating member (40) in a plurality of assembly positions, the sliding direction of the sliding unit being maintained in the assembly positions and a rotation direction of the actuating member (40) being changed, and wherein the actuating member (40) is configured as a pinion with teeth that co-operate with toothing of the rack-shaped adjusting member, the improvement comprising:

the adjusting member (23) positioned transverse with respect to the sliding direction of the rotational axis of the actuating member (40) and perpendicular to the rotational axis of the actuating member (40) and engageable with the pinion on one of a left-hand side and a right-hand side, the sliding unit (20) having a breakthrough area (21) in which the actuating member (40) is accommodated, the sliding unit (20) being coupled to at least one sliding rod (63) of the locking mechanism, and a plurality of securing points at which the sliding unit (20) is connected to the sliding rod (63) and at which a pivot point of the actuating member (40) is connected being arranged on a line along the sliding direction.

9. In the sliding rod closure according to claim 8, wherein the sliding unit (20) is adjustably mounted in the sliding direction in a casing (10), and the casing (10) rotatably bears a rotary body (30), and the actuating member (40) is held non-rotatable on the rotary body (30).

10. In the sliding rod closure according to claim 9, wherein the casing (10), the sliding unit (20), the rotary body (30) and the actuating member (40) are combined into a pre-assembled unit, and the sliding unit is bound via coupling elements (22) to the at least one sliding rod (63) of the locking mechanism.

11. In the sliding rod closure according to claim 8, wherein the sliding unit (20) is disposed on the front side of the cabinet door (60) and the sliding rod (63) on the rear side of the cabinet door (60) and the cabinet door (60) has an opening through which the sliding unit (20) is connected to the sliding rod (63).

* * * * *